US007399059B2

(12) United States Patent
Morooka et al.

(10) Patent No.: US 7,399,059 B2
(45) Date of Patent: Jul. 15, 2008

(54) INK JET PRINTING APPARATUS, INK JET PRINTING METHOD, INFORMATION PROCESSING DEVICE AND PROGRAM

(75) Inventors: Yoshinori Morooka, Tokyo (JP); Yoshiyuki Shino, Yokohama (JP)

(73) Assignee: Canon Finetech Inc., Ibaraki (JP)

( * ) Notice: Subject to any disclaimer, the term of this patent is extended or adjusted under 35 U.S.C. 154(b) by 270 days.

(21) Appl. No.: 11/236,738

(22) Filed: Sep. 28, 2005

(65) Prior Publication Data

US 2006/0071954 A1 Apr. 6, 2006

(30) Foreign Application Priority Data

Oct. 1, 2004 (JP) ..... 2004-290558
Oct. 25, 2004 (JP) ..... 2004-309816

(51) Int. Cl.
*B41J 2/155* (2006.01)

(52) U.S. Cl. ..... 347/42; 347/13; 347/43

(58) Field of Classification Search ..... 347/9, 347/12–13, 42, 43; 358/1.5; 395/1.08
See application file for complete search history.

(56) References Cited

U.S. PATENT DOCUMENTS 5,619,622 A * 4/1997 Audi et al. ..... 358/1.8
5,742,305 A * 4/1998 Hackleman ..... 347/42

FOREIGN PATENT DOCUMENTS

JP 2005-238556 9/2005

* cited by examiner

*Primary Examiner*—Lam S Nguyen
(74) *Attorney, Agent, or Firm*—Fitzpatrick, Cella, Harper & Scinto

(57) ABSTRACT

An ink jet printing apparatus having excellent throughput can continue a printing operation without interruption if one or more line heads falls into an unprintable state when the apparatus is printing images of the same color using a plurality of line heads. For this purpose, image data for images of the same color is divided and the divided image data is supplied to such a line head of the plurality of line heads intended to form images of the same color that is capable of ejecting ink properly, so that the ink ejectable line head performs the printing operation according to the supplied image data.

12 Claims, 10 Drawing Sheets

INK JET PRINTING APPARATUS, INK JET PRINTING METHOD, INFORMATION PROCESSING DEVICE AND PROGRAM

This application claims priority from Japanese Patent Application Nos. 2004-290558 filed Oct. 1, 2004 and 2004-309816 filed Oct. 25, 2004, which are hereby incorporated by reference herein.

BACKGROUND OF THE INVENTION

1. Field of the Invention

The present invention relates to an ink jet printing apparatus, a printing method, a print medium and a program. More particularly, this invention relates to an ink jet printing apparatus, a printing method, a print medium and a program for forming an image on a print medium by dividing an image of one color into a plurality of images of the same color and printing the divided images as the print medium is transported using a plurality of line heads arranged along a transport direction of the print medium.

2. Description of the Related Art

In repetitively printing fixed images, such as business forms, in large volumes, a dry electrophotographic printer has been used. In recent years, an ink jet printing apparatus has come to be spotlighted as a printer that can take the place of the dry electrophotographic printer. The ink jet printing apparatus in general can handle a large quantity of printing processing because it directly prints on rolled paper. Because of this capability and its low running cost, the ink jet printing apparatus is suited for printing various kinds of business forms, such as application forms for insurance, notification slips of utility fees and application forms for mail-order purchase.

A line type ink jet printing apparatus, which uses a line head having a large number of ink ejection nozzles arrayed in a direction perpendicular to the transport direction of a print medium, is known to be particularly suited for a high-speed printing of such materials as pasteboards, label or tag sheets, and business forms among others. A commonly used line type ink jet printing apparatus to form a color image has a plurality of line type ink jet print heads (also referred to simply as line heads) arranged in the transport direction of the print medium so that different line heads eject different color inks to form a color image. That is, one line head produces an image of one color. Therefore, in the commonly used line type printing apparatus, its maximum printing speed is determined by a maximum drive frequency of each line head.

In other words, the general ink jet printing apparatus cannot realize a printing speed in excess of the maximum drive frequency of a single line head (a maximum nominal frequency at which ink can be repetitively ejected in one second while keeping a stable image quality). Therefore, the general line type printing apparatus has a problem of being unable to meet the market demand for an improved printing speed.

Aside from the above-described general line type ink jet printing apparatus, another line type ink jet printing apparatus has been proposed which divides an image of one color into a plurality of images of the same color and prints them with a corresponding number of print heads. This printing apparatus rasterizes the image data of one color, divides the raster data generated, and allocates the divided raster data to a plurality of line heads for printing. Unlike the general line type ink jet printing apparatus, which forms an image of one color with one print head, this ink jet printing apparatus with multiple line heads can print an image at a frequency in excess of the maximum drive frequency of one line head. This allows for a printing operation at a higher speed than is possible with the conventional printing apparatus (for example, see Japanese Laid-Open Patent Application No. 2005-238556, which corresponds to Japanese Patent Application No. 2004-049447).

The high-speed line type ink jet printing apparatus, however, has a problem that, should any one of a plurality of line heads ejecting the same color ink deteriorate in the ink ejection performance, a proper image printing cannot be continued. The ink ejection performance of the line head can be degraded by a variety of factors, such as heat, pressure or chemical reaction with ink during the process of ink ejection. The degree of performance degradation is not uniform among a plurality of line heads and only one of the line heads often reaches the end of its service life early. In conventional apparatus, when it is decided that only one of the print heads has reached the end of its life during the printing operation, there is no alternative but to interrupt the printing operation and replace the print head in question.

When a sub ink tank is provided for each line head, inks in the sub tanks are not necessarily consumed uniformly. Thus, if, for example, the amount of remaining ink becomes too small in only one sub tank and the print head associated with that sub tank fails to print, an operator is left with only two options: one is to continue the printing operation in a state where the print quality cannot be guaranteed, and the other is to stop the printing operation and replenish the ink.

However, it is desired that the printing operation be continued as much as possible because the line type ink jet printing apparatus normally is required to achieve a high throughput. In the event of an ink ejection failure, the continued printing operation will deteriorate the print quality. That is, continuing the printing operation and maintenance of the print quality may contradict each other.

It may be conceived to prolong the service life of the line heads and increase the capacity of the sub tanks as countermeasures against the above problem. However, there are many difficulties that need to be overcome before such countermeasures can be realized because prolonging the service life of the line heads requires a lot of time and cost for research and development and increasing the sub tank capacity will result in an increase in the overall size of the printing apparatus and a cost increase.

In printing business forms or fixed form paper, each page of the print medium such as a paper sheet is printed with a large number of lines repetitively as shown in FIG. 10. In this case, if the raster data that was generated by rasterizing the image data is divided and allocated to a plurality of line heads for printing, a problem may occur in which only a particular line head is used concentratedly and the replacement frequency of that line head increases.

SUMMARY OF THE INVENTION

An object of this invention is to provide an ink jet printing apparatus having excellent throughput which can continue the printing operation without interruption even if a part of line heads falls into an unprintable state when the apparatus is printing images of the same color using a plurality of line heads.

Another object of this invention is to prevent any particular print head from being used concentratedly and thereby keep the replacement frequency of the print heads low.

To achieve the above objectives, the present invention has the following construction.

Viewed from a first aspect, the present invention provides an ink jet printing apparatus which forms an image by dividing the image of one color into a plurality of images of the same color and printing the divided images of the same color using a plurality of line heads arranged in a direction in which a print medium is transported by print medium transport means, the ink jet printing apparatus comprising: image data supply means for dividing image data of one color into a plurality of image data of the same color and supplying the divided image data to such a line head of the plurality of line heads intended to print the images of the same color that can eject ink properly; and control means for controlling a printing operation of the ink ejectable line heads according to the image data supplied by the image data supply means.

A second aspect of the present invention provides an ink jet printing apparatus which forms an image by dividing the image of one color into a plurality of images of the same color and printing the divided images of the same color using a plurality of line heads arranged in a direction in which a print medium is transported by print medium transport means, the ink jet printing apparatus comprising: ink-ejectable head detection means for detecting such a line head of the plurality of line heads intended to print the images of the same color that can eject ink properly; image data supply means for dividing image data of one color into a plurality of image data of the same color by the number of the ink ejectable line heads detected by the ink-ejectable head detection means and supplying the divided image data to the ink ejectable line heads; and control means for controlling a printing operation of the ink ejectable line heads according to the divided image data supplied from the image data supply means.

A third aspect of the present invention provides an ink jet printing method which forms an image by dividing the image of one color into a plurality of images of the same color and printing the divided images of the same color using a plurality of line heads arranged in a direction in which a print medium is transported by print medium transport means, the ink jet printing method comprising: an ink-ejectable head detection step to detect those of the plurality of line heads intended to print the images of the same color which can eject ink properly; an image data dividing step to divide image data of one color into a plurality of image data of the same color by the number of ink ejectable line heads detected by the ink-ejectable head detection step; an image data supply step to supply the image data divided by the image data dividing step to the ink ejectable line head; and a control step to control a printing operation of the ink ejectable line heads according to the divided image data supplied from the image data supply step.

A fourth aspect of the present invention provides an information processing device capable of sending image data for a plurality of images of one color to an ink jet printing apparatus that prints the images of one color by using a plurality of line heads arranged in a direction in which print medium transport means transports a print medium, the information processing device comprising: ink-ejectable head detection means for detecting those of the plurality of line heads intended to print the images of the same color which can eject ink properly; image data dividing means for dividing image data of one color into a plurality of image data of the same color by the number of ink ejectable line heads detected by the ink-ejectable head detection means; and image data sending means for sending the image data divided by the image data dividing means to the ink jet printing apparatus.

A fifth aspect of the present invention provides an ink jet printing apparatus which forms an image by dividing the image of one color into a plurality of images of the same color and printing the divided images of the same color using a plurality of line heads arranged in a direction in which a print medium is transported by print medium transport means, the ink jet printing apparatus comprising: data supply means for dividing raster data generated by rasterizing image data of one color and allocating the divided raster data to the plurality of line heads; and control means for controlling a printing operation of line heads according to the raster data allocated by the data supply means; wherein the data supply means allocates the divided raster data to the plurality of line heads such that, during the printing of the image data, the number of dots printed by each line head is equal among the line heads.

A sixth aspect of the present invention provides an ink jet printing apparatus which forms an image by dividing the image of one color into a plurality of images of the same color and printing the divided images of the same color using a plurality of line heads arranged in a direction in which a print medium is transported by print medium transport means, the ink jet printing apparatus comprising: data supply means for dividing raster data generated by rasterizing image data of one color and allocating the divided raster data to the plurality of line heads; and control means for controlling a printing operation of line heads according to the raster data allocated by the data supply means;

wherein the image data comprises a plurality of pages and, when allocating the divided raster data to the plurality of line heads during the printing of the image data, the data supply means changes the data allocation to the line heads every page.

A seventh aspect of the present invention provides an ink jet printing method which forms an image by dividing the image of one color into a plurality of images of the same color and printing the divided images of the same color using a plurality of line heads arranged in a direction in which a print medium is transported by print medium transport means, the ink jet printing method comprising: a data supply step to divide raster data generated by rasterizing image data of one color and allocate the divided raster data to the plurality of line heads such that the number of dots printed by each line head is equal among the line heads; and a control step to control a printing operation of the line heads according to the raster data allocated by the data supply step.

An eighth aspect of the present invention provides an ink jet printing apparatus including:

a first print mode to print the image data by the plurality of line heads; and a second print mode to print the image data of one color by one line head; wherein the first print mode and the second print mode can be selectively executed.

A ninth aspect of the present invention provides an ink jet printing method which forms an image by dividing the image of one color into a plurality of images of the same color and printing the divided images of the same color using a plurality of line heads arranged in a direction in which a print medium is transported by print medium transport means, the ink jet printing method comprising: a data supply step to divide raster data generated by rasterizing image data of one color and allocate the divided raster data to the plurality of line heads; and a control step to control a printing operation of the line heads according to the raster data allocated by the data supply step; wherein the image data comprises a plurality of pages and, when allocating the divided raster data to the plurality of line heads during the printing of the image data, the data supply step changes the data allocation to the line heads every page.

A tenth aspect of the invention provides a storage medium storing a control program, the control program realizing the printing method described above by using a computer.

An eleventh aspect of the invention provides a control program to realize the printing method described above by using a computer.

When, among a plurality of line heads intended to form images of the same color, there is a line head unable to eject ink properly, this invention divides image data and supplies the divided image data to the line heads excluding the failed one. This allows an appropriate printing operation to be executed without interruption, using line heads that can eject ink properly. Therefore, if, for example, there is a line head whose remaining service life is short, or if a sub tank supplying ink to a line head is running low on ink, an image forming operation can be continued properly by using those line heads with sufficient remaining service life or sub tanks containing sufficient volume of ink. As a result, the throughput of the printing apparatus improves. Further, since a continued operation is assured, there is an advantage that a problem of wasting paper that occurs when the printing operation is stopped can be avoided.

Furthermore, this invention can avoid any particular print head being used concentratedly, which in turn keeps the replacement frequency of the print heads low.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of this invention will be described in detail by referring to the accompanying drawings.

First Embodiment

Figure 1:
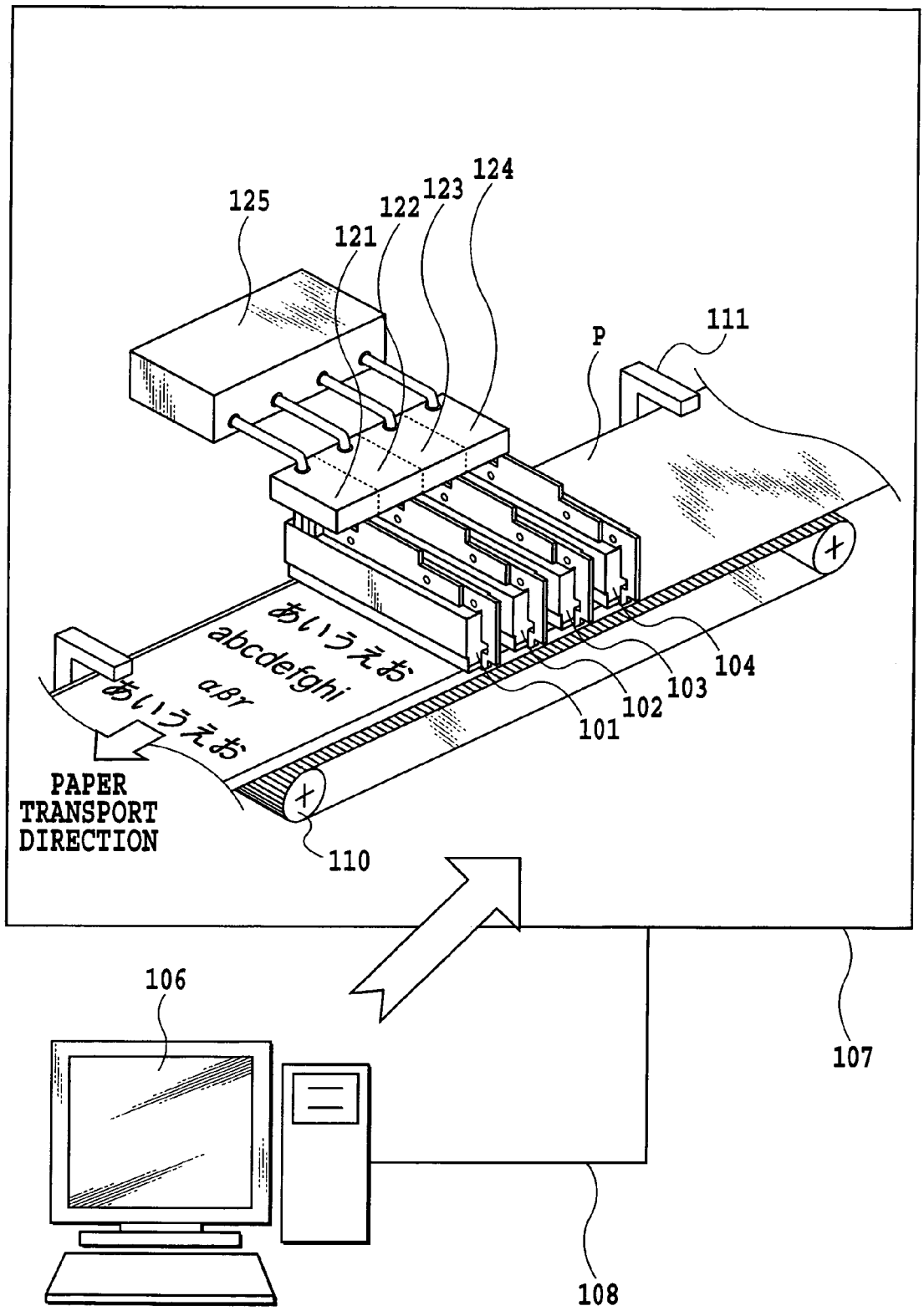
FIG. 1 is a schematic perspective view showing an essential part of a construction of the ink jet printing system as one embodiment of the present invention.

FIG. 1 illustrates a main configuration of the ink jet printing system in the embodiment of this invention.

The ink jet printing system of this embodiment comprises an ink jet printing apparatus 107 that performs a printing operation on a print medium, and a host computer 106 that sends and receives a variety of data to and from the ink jet printing apparatus 107. The host computer 106 and the ink jet printing apparatus 107 are connected through a printer cable 108. Various data including image data and a cleaning command processed by the host computer 106 are transmitted to the ink jet printing apparatus 107 which, according to these data, performs printing. A printer status of the ink jet printing apparatus 107, such as error data, is sent to the host computer 106 so that the host computer can recognize the condition of the ink jet printing apparatus.

The ink jet printing apparatus of this embodiment forms a monochrome image using four elongate line heads that eject ink based on the ink jet printing method.

That is, the ink jet printing apparatus 107 has, as a printing means, four line heads 101-104 parallelly arranged in a transport direction of the print medium P. Each of the line heads has a plurality of arrayed nozzles for ejecting a black ink according to the ink jet printing method. In each of the nozzles of the line head there is provided an electrothermal transducer (or heater). Ink in each nozzle is ejected from the opening of the nozzle by the thermal energy generated by the associated electrothermal transducer.

The four line heads are each removably mounted with independent sub tanks 121-124. A black ink contained in each sub tank 121-124 is supplied to the associated line head 101-104. When the amount of remaining ink in any of the sub tanks 121-124 is less than a predetermined volume, the black ink stored in a common main tank 125 is supplied to that sub tank 121-124.

In the common main tank 125 and the sub tanks 121-124, a pair of electrodes facing each other with a predetermined gap therebetween is disposed a predetermined distance above the bottom of each tank, extending upward to the top of the tank. When the ink exists between the paired electrodes, these electrodes pass an electric current to detect a state in which the ink can be supplied to the print head. Conversely, when there is no ink between the paired electrodes, an electric current does not flow between the electrodes, detecting a state in which the amount of remaining ink is running low.

The print medium P is fed by a transport unit 110, made up of an endless transport belt and transport rollers driven by a motor, along a transport path beneath the line heads 101-104. In this feeding operation, when the front end of the print medium P is detected by a print medium sensor 111 located upstream of the line head 101 in the transport direction, the printing operation on the print medium P is started at a predetermined timing with the print medium detection time taken as a reference. FIG. 1 shows a case where continuous paper is used as the print medium P.

Figure 2:
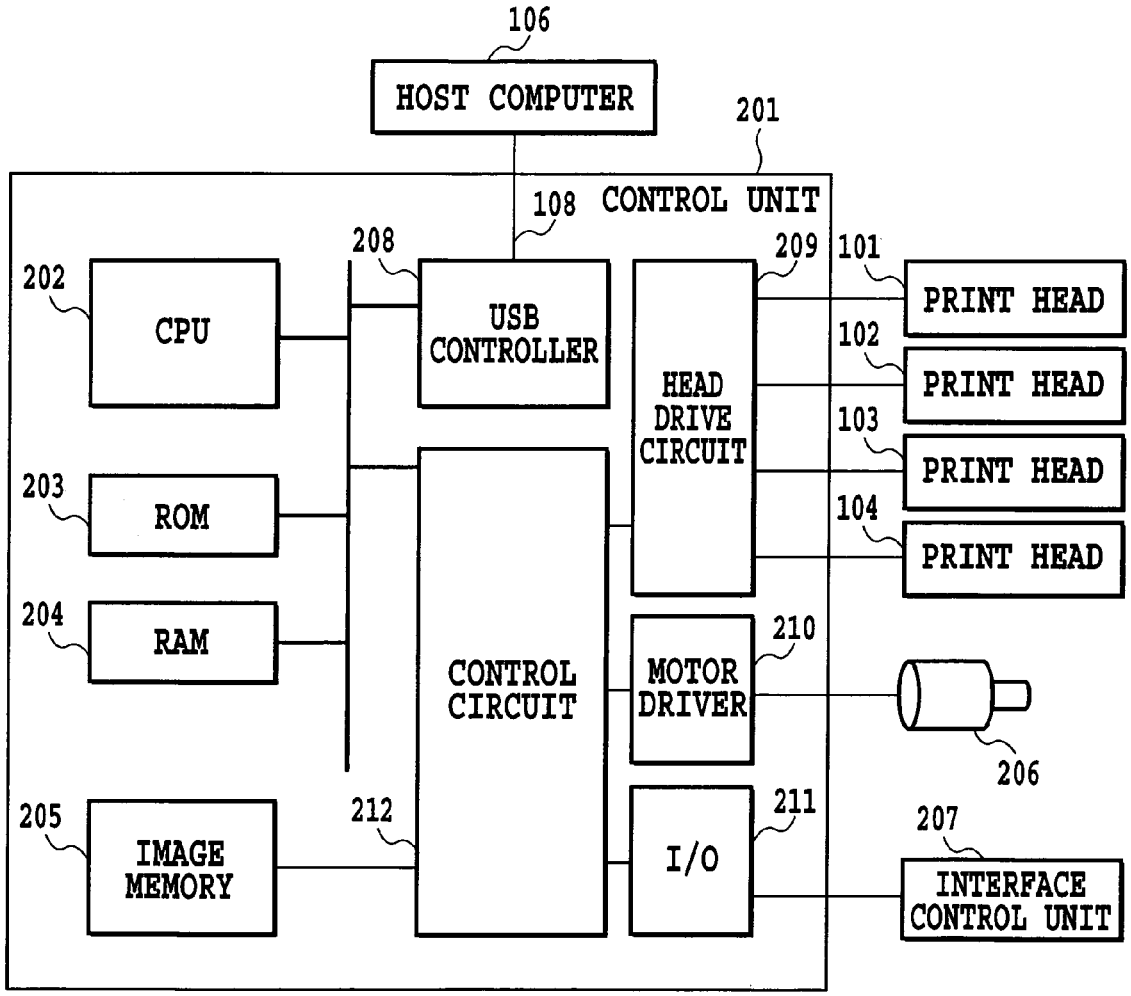
FIG. 2 is a block diagram showing an outline configuration of a control unit in a line type ink jet printing apparatus used in the embodiment of this invention.

FIG. 2 is a block diagram showing an outline configuration of a control unit 201 in the line type ink jet printing apparatus used in this embodiment.

The control unit 201 has a CPU 202, a ROM 203, a RAM 204 and an image memory 205. The CPU 202 performs various calculations, decision making and control. The ROM 203 stores a control program and others. The RAM 204 is used as a work area in which the CPU 202 processes various data and as a reception buffer. The image memory 205 is used as an image rasterizing unit.

The control unit 201 includes a head drive circuit 209, a motor driver 210, an interface control unit 207, and a control circuit 212. Of these, the head drive circuit 209 activates the electrothermal transducers in each line head 101-104. The motor driver 210 drives various motors 206 to control the cleaning operation to keep the print heads 101-104 in an optimum condition and the printing operation. The control circuit 212 controls the head drive circuit 209, the motor driver 210 and the I/O 211 according to control signals from the CPU 202. An interface control unit 207 is connected between the transport unit 110 and the I/O.

The printing apparatus receives image data and cleaning commands from the host computer (information processing device) 106 through the printer cable 108 and USB controller 208 and operates according to these data and commands.

Figure 3:
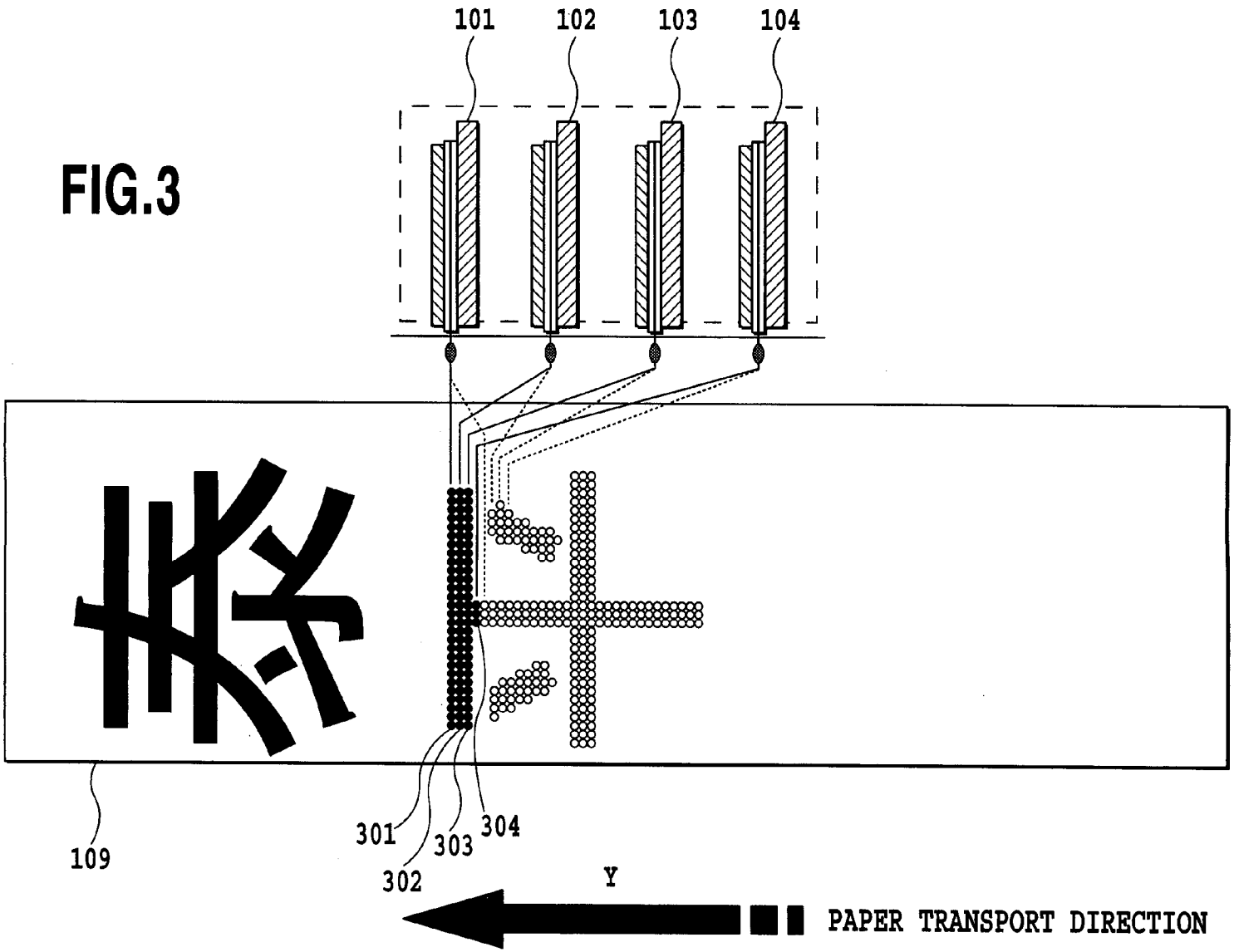
FIG. 3 is an explanatory diagram showing a printing operation of the ink jet printing apparatus in the embodiment of this invention when all line heads can eject ink properly.

Next, a divided printing operation of the ink jet printing apparatus of the above construction will be explained by referring to FIG. 3.

The printing of the print medium P is done based on a horizontal synchronization signal synchronized with the feeding of the print medium P. When a horizontal synchronization signal is detected, one raster of image data stored in the black image memory 205 is transferred to the line head 101, situated most downstream among the line heads in the print medium transport direction (Y direction), to print a 1-raster image 301. When the next horizontal synchronization signal is detected, the next one raster of image data read out from the black image memory 205 is transferred to the line head 102 to form a raster image 302. When the next horizontal synchronization signal is detected, the next one raster of image data in the black image memory 205 is transferred to the line head 103 to form a raster image 303. After this, when another horizontal synchronization signal is detected, the next one raster of image data is transferred from the black image memory 205 to the line head 104 to form a raster image 304. In this way, the line heads 101-104 are activated successively to print an image one raster at a time.

As described above, in the first embodiment when the four line heads are in a condition to be able to eject a black ink properly, monochrome image data rasterized in a continuous area is successively fed one raster at a time to the four black print heads. Thus, the four line heads print their assigned image data to form a monochrome image. Therefore, the monochrome image can be printed at a frequency up to four times the maximum drive frequency of one print head. As a result, this printing apparatus has a printing throughput four times that of the printing operation using a single print head.

A procedure for the control operation when the image division number is changed in the first embodiment will be explained by referring to FIG. 4.

Figure 4:
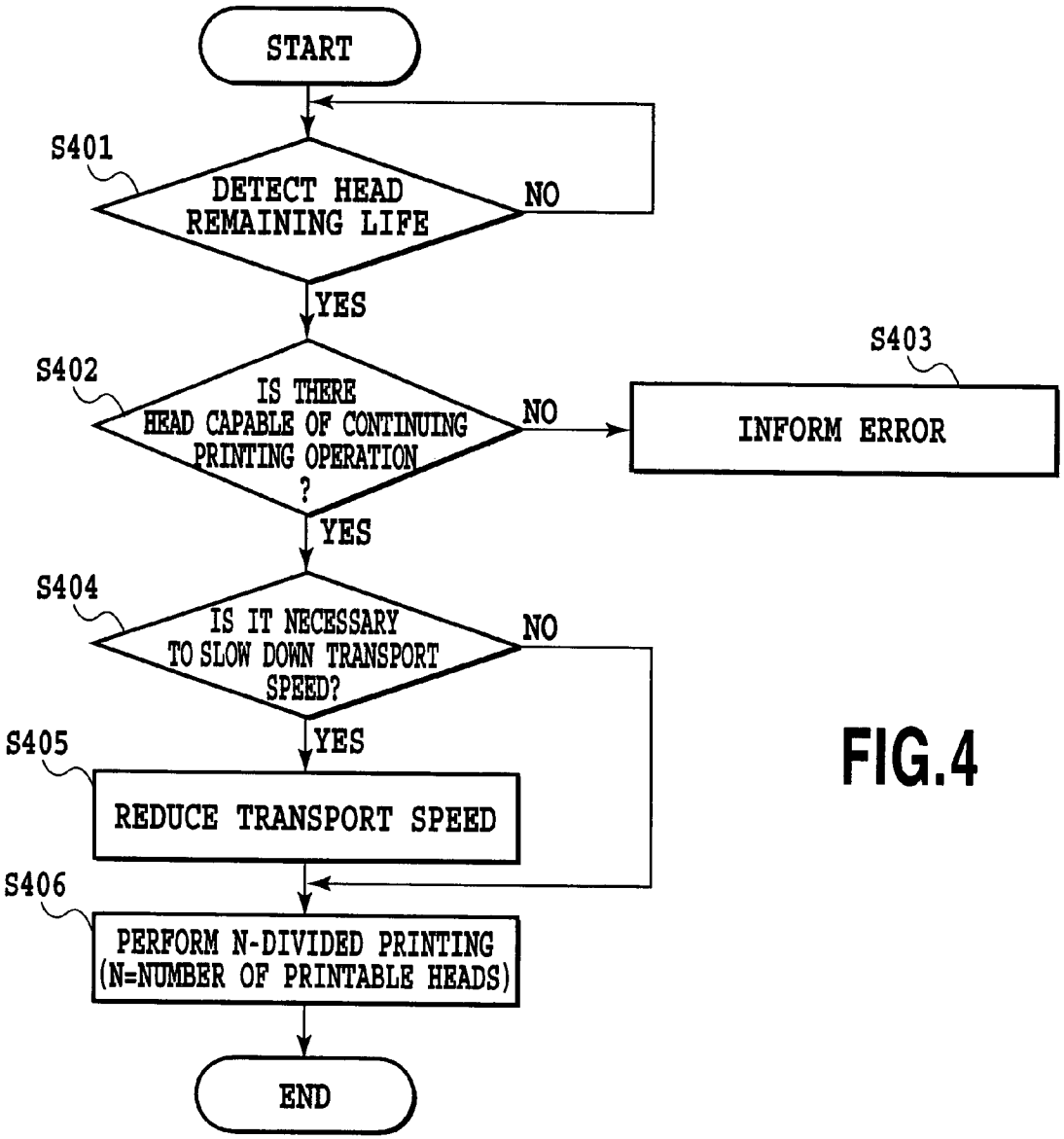
FIG. 4 is a flow chart of a control on the printing operation performed according to a remaining service life of the line head in the embodiment of this invention.

FIG. 4 is a flow chart showing a printing operation control performed according to the remaining service life of the print head.

The control unit 201 of the ink jet printing apparatus counts the total number of times that the line heads have ejected an ink droplet from when the line heads began to be used up to the present time and, based on the count, determines the remaining service life of each line head (S401). That is, based on the cumulative count value produced by the control unit 201 and the initial service life or longevity of each line head, it is checked whether the remaining service life of each line head has reached a preset threshold. For a line head whose remaining service life has reached the threshold, it is decided that the line head in question has only a short life remaining which is not enough to continue the printing operation. The remaining service life of the line head depends on the cumulative number of ejections per nozzle and the initial service life or longevity is represented, for example, by a nominal value of $5\times10^8$ [dots/nozzle]. This nominal value of the initial service life is statistically obtained and almost guaranteed, but depends also on the environmental condition in which the printing apparatus is used. Since the cumulative number of ejections for each nozzle is determined by the print data supplied, if all the line heads have the same service lives in the initial condition and begin to be used at the same time, the remaining service life will vary among the line heads over the long period of use. Therefore, it is necessary to detect the remaining service life of each line head.

When a line head with a short remaining service life is detected, the control unit identifies line heads that can continue the printing operation and also determines the number of such available line heads (S402). If there are one or more line heads available for the remaining printing operation, a check is made as to whether it is necessary to slow down the currently set transport speed of the print medium when the printing operation is continued by dividing and allocating the remaining print data among the available print heads (S404). That is, in a check step of S402, if the number of available print heads decreases, the maximum printable frequency at which the remaining printable heads can eject ink droplets, i.e., the maximum printing speed, also decreases. Thus, a check is made to see if the printing operation can be continued at the currently set transport speed.

If it is decided that the transport speed needs be slowed down, the transport speed is reduced and the printing operation is continued (S405). If there is no need to slow down the transport speed, the current transport speed is maintained. After this, image data is successively fed one raster at a time to the printable heads so that a monochromatic image is printed using the remaining printable heads that print their share of the image (S406). When the number of remaining print heads is zero, the control unit stops the printing operation and displays an error on the display unit of the ink jet printing apparatus. Further, the control unit also sends an error signal to the host computer 106 for indication of the error on the computer display (S403). The line head that was determined to have a short remaining life may be replaced after a series of printing operations is stopped.

As described above, if a plurality of print heads in the printing apparatus reach the end of their service life at almost the same time, the printing apparatus can continue operation. But such a case is considered very rare.

As described above, if there is a line head among multiple line heads whose remaining life is considered too short to continue the series of printing operations, the printing operation is switched to one that uses only the remaining printable heads before the line head in question fails. This allows the printing apparatus to continue the printing operation without degrading the print quality.

Figure 5:
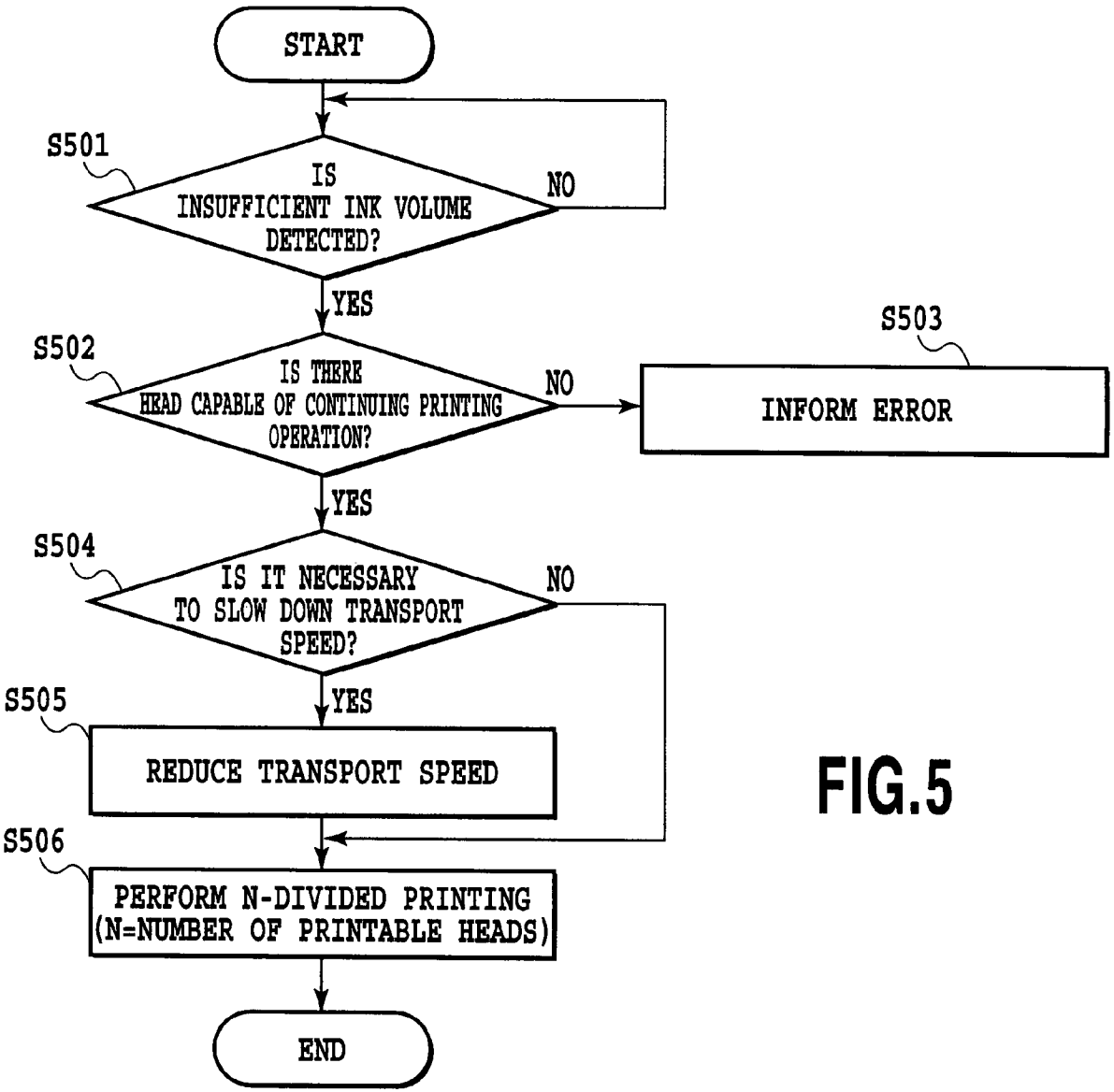
FIG. 5 is a flow chart of a control on the printing operation performed according to a remaining ink volume in the sub tank provided for each line head in the embodiment of this invention.

FIG. 5 is a flow chart showing a printing operation control performed according to the remaining volume of ink in each of the sub tanks 104-101 mounted to the individual line heads.

As described above, a remaining ink volume detection means having a pair of electrodes is installed in each sub tank 104-101. The remaining ink volume detection means checks if the amount of ink remaining in each sub tank falls below a predetermined volume (i.e., if the ink volume in the sub tank is running low) and sends the result of check to the control unit 201 of the ink jet printing apparatus. If at least one of the sub tanks 104-101 is found to have an insufficient volume of ink (S501), the control unit 201 checks if there are any sub tanks with enough ink volume (S502). If so, the control unit 201 determines the locations and the number of such sub tanks with enough ink volume. Then, it is checked whether the currently set print medium transport speed needs to be reduced when the line heads (printable heads) connected to the sub tanks with enough ink volume are used to perform the divided printing operation (S504). If so, the transport speed is reduced (S505). If not, the current transport speed is maintained. Then, the image data is supplied successively one raster at a time to those line heads connected to the sub tanks with sufficient ink volume (printable heads) to print a monochrome image by dividing the image among the printable heads (S506).

When the number of printable line heads is zero, the printing operation is stopped and, as described earlier, the control unit notifies the ink jet printing apparatus 107 and the host computer 106 of the error (S503).

As described above, in the first embodiment, when there is a sub tank among multiple sub tanks whose ink volume is considered insufficient for a series of printing operations, the printing mode is switched to the one that uses only those line heads connected to the sub tanks with enough ink volume to form an image, before the remaining ink in the sub tank in question is completely consumed. Therefore, the printing operation can be continued without degrading the print quality.

Next, the printing operation when, of the four line heads 101-104, the line head 102 becomes unusable will be explained in detail.

When the remaining life of the line head 102 is shorter than a predetermined period or when the remaining ink volume in the sub tank 202 falls below a predetermined volume, the control unit 201 decides that the line head 102 is not fit for the continued printing operation. In this case, the control unit checks, based on the horizontal synchronization signal, if the remaining three line heads can print at the current transport speed of the print medium P. If the printing operation cannot be done at this transport speed, the control unit lowers the transport speed to a level at which they can print. Since the maximum transport speed at which the printing can be done is proportional to the number of print heads, a correspondence between the maximum printable transport speeds and the numbers of print heads is written in a control program in advance. After the printable speed is selected, the division number for image data is changed from 4 to 3.

Figure 6:
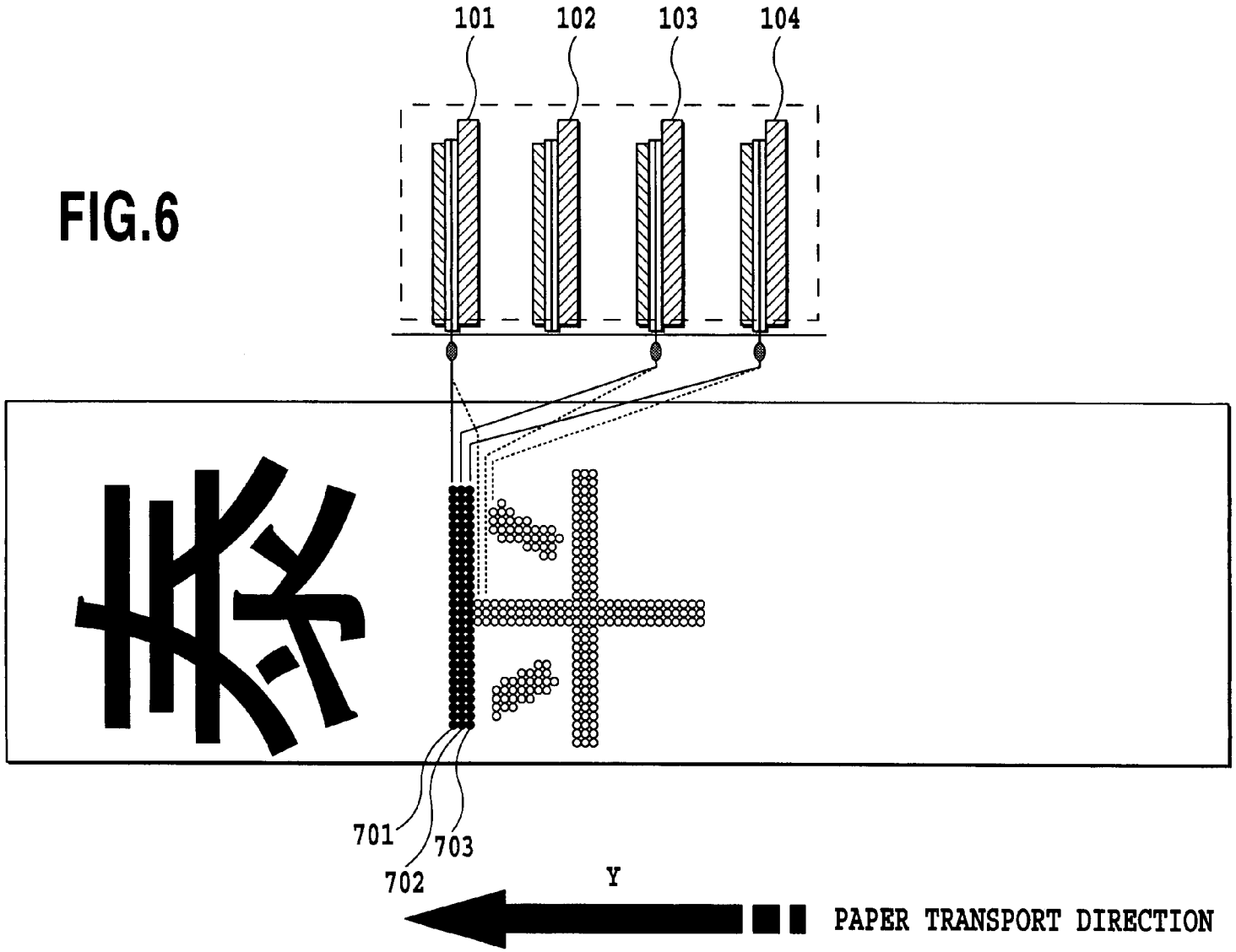
FIG. 6 is an explanatory diagram showing a printing operation of the ink jet printing apparatus in the embodiment of this invention when one of four line heads fails.

After this, using the three printable line heads 101, 103, 104, the printing operation such as shown in FIG. 6 is performed. That is, when a horizontal synchronization signal is detected, one raster of image data stored in the black image memory 205 is transferred to the line head 101 (printable head) situated most downstream in the print medium transport direction (Y direction). The line head 101 then prints a raster image 701. Next, when another horizontal synchronization signal is detected, one raster of image data read from the black image memory 205 is transferred, not to the line head 102, but to the printable line head 103 which then forms a raster image 702. Further, when the next horizontal synchronization signal is detected, the next one raster of image data read from the black image memory 205 is transferred to the line head 104 which then forms a raster image 703. In subsequent operations, the three black heads 101, 103, 104 similarly divide and share the image forming operation by printing one raster at a time successively.

As described above, in the first embodiment, as long as printable line heads exist among a plurality of line heads, if some of them fall into an unprintable condition, the printing operation can be switched to a mode that supplies image data to only the printable heads. This allows a series of printing operations to be continued without an interruption. Therefore, the first embodiment can improve throughput significantly when compared with a case where the printing operation is temporarily suspended for head replacement or ink replenishing.

Further, since, should some line heads fail, the series of printing operations can be continued without degrading a print quality, it is possible to protect against wasteful consumption of the print medium and ink.

In the above first embodiment, we have described an example case where the remaining service life of each line head and the remaining volume of ink are detected and, based on the result of detection, the image data supply mode is switched. It is noted, however, that the present invention is not limited to the above embodiment and that other quantities than the remaining service life and the remaining ink volume may be detected and, based on the result of detection, the image data supply mode may be switched. For example, an ejection failure detection means for detecting improper ejections from the print heads may be provided so that image data can be divided and supplied only to those line heads excluding the failed head detected by the ejection failure detection means. Further, it is also possible to remove from service those line heads whose temperatures are found abnormal by a print head temperature detection means and to divide and supply image data to the remaining printable line heads. That is, whatever detection means may be applied as long as it can identify those line heads capable of proper ink ejection, and the present invention is not limited to the above embodiment.

Further, in the first embodiment, a pair of electrodes installed in each tank is used as an ink remaining volume detection means to detect the ink remaining volume. The ink remaining volume detection means, however, may detect the number of ink ejections from each line head to detect the ink remaining volume. In this case, the construction of the ink tank can be simplified and the manufacturing cost reduced. At the same time, it is also possible on the host computer side to estimate the ink remaining volume based on the image data.

Further, in the first embodiment, the control unit provided in the ink jet printing apparatus has been described to realize the function of an printable head detection means to detect print heads that can eject ink properly and the function of an image data dividing means to divide the image data of one color by the number of printable heads detected by the printable head detection means. These functions, however, may be offered by the host computer. That is, the host computer may be made to transmit to the ink jet printing apparatus the divided image data and the control data to identify the line heads to which the divided image data should be supplied. In this case, the ink jet printing apparatus may supply the divided image data and control data for specifying the line head to be supplied the divided image data. With this arrangement, it is possible to produce the similar effects to those of the above embodiment. Furthermore, the control operation on the part of the ink jet printing apparatus can be made more simple.

Further, in the first embodiment, we have described a case where only a black ink is used to form a monochrome image. This invention is also applicable to a case where ink images of other than black ink are divided and printed using a plurality of print heads.

Next, other embodiments of this invention will be explained by referring to the accompanying drawings.

Second Embodiment

Next, a second embodiment of this invention will be described by referring to FIG. 8 through FIG. 10.

This second embodiment also has the same construction of FIG. 1 and FIG. 2 as in the first embodiment. The following explanation, therefore, mainly concerns an image forming operation executed by the second embodiment of the ink jet printing apparatus 107.

The ink jet printing apparatus of the second embodiment is characterized by the fact that, in dividing raster data, which is obtained by rasterizing the image data of one color, into a plurality of images of the same color and allocating the divided raster data to a plurality of print heads, the method of allocating the divided raster data is changed in units of pages. This is explained in detail by referring to FIG. 7.

Figure 7:
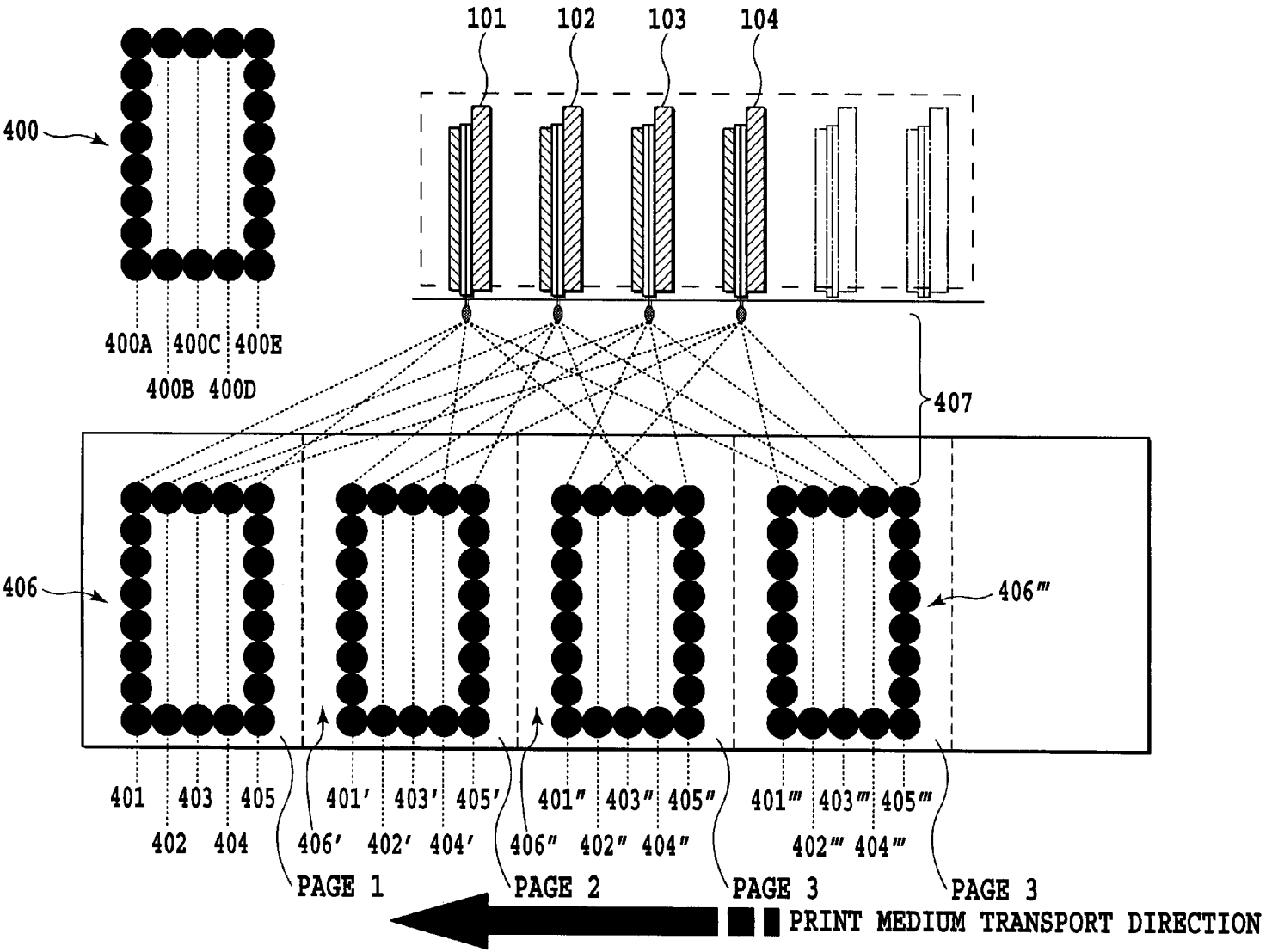
FIG. 7 is an explanatory diagram showing a divided image forming means in the printing apparatus as a first embodiment of this invention.

In FIG. 7, denoted 400 is raster data produced by rasterizing the image data to be printed on each page of the print medium P. 400A (8 dots), 400B (2 dots), 400C (2 dots), 400D (2 dots), 400E (8 dots) are divided raster data.

Processing on the first page involves allocating the raster data 400A (8 dots) to the line head (101) according to a print medium transport position detection signal from an encoder (not shown). Similarly, at the next timing the raster data 400B (2 dots) is allocated to the line head (102), the raster data 400C (2 dots) to the line head (103), the raster data 400D (2 dots) to the line head (104), and the raster data 400E (8 dots) to the line head (101), respectively, for raster printing (401-405) to form an output image 406.

When the processing on one page is finished, the line head (101) has printed 16 dots, the line head (102) two dots, the line head (103) two dots, and the line head (104) two dots.

Processing on the second page allocates the divided raster data 400A (8 dots), 400B (2 dots), 400C (2 dots), 400D (2 dots), 400E (8 dots) to the line heads different from those of the first page.

For example, the raster data 400A (8 dots) is allocated to the line head (102), the raster data 400B (2 dots) to the line head (103), the raster data 400C (2 dots) to the line head (104), the raster data 400D (2 dots) to the line head (101), and the raster data 400E (8 dots) to the line head (102) for raster printing (401'-405') to form an output image 406'.

Processing on the third page allocates the raster data 400A (8 dots) to the line head (103), the raster data 400B (2 dots) to the line head (104), the raster data 400C (2 dots) to the line head (102), the raster data 400D (2 dots) to the line head (101), and the raster data 400E (8 dots) to the line head (103) for raster printing (401"-405") to form an output image 406".

Similarly, processing on the fourth page allocates the raster data 400A (8 dots) to the line head (104), the raster data 400B (2 dots) to the line head (101), the raster data 400C (2 dots) to the line head (102), the raster data 400D (2 dots) to the line head (103), and the raster data 400E (8 dots) to the line head (104) for raster printing (401'''-405''') to form an output image 406'''. Denoted 407 are lines representing a match between the line heads (104 to 101) and the raster printing (401-405, 401'-405', 401"-405", 401'''-405''').

As a result of the processing by the divided image forming means, when the processing on the fourth page is complete, the cumulative number of pixels printed by the line head (101) is 22 dots, that of the line head (102) is 22 dots, that of the line head (103) is 22 dots, and that of the line head (104) is 22 dots. This indicates that the image forming processing of this embodiment has the cumulative printed pixel number equalized among the line heads.

As described above, in the second embodiment, when printing the same image data of the single color on multiple pages, such as printing lines of business forms, the image forming processing involves rasterizing the image data, dividing the generated raster data, and allocating the divided raster data to a plurality of line heads for printing. Then, in allocating the data, the line heads to which the raster data is allocated are changed every page. This avoids any particular line head being used concentratedly, thereby preventing a problem of that particular line head having a high replacement rate.

In the above explanation, the line heads to which the divided raster data is allocated are shifted one head every page. This invention is not limited to this method of line head allocation changing and any appropriate method may be employed as long as it ensures that the multiple line heads can be used at equal rates. For example, the line heads as the destinations of the divided raster data may be randomly changed.

Third Embodiment

In the above second embodiment, the line heads to which the divided raster data is allocated are changed every page to avoid any particular line head being used excessively. The third embodiment is characterized by the fact that, in dividing the raster data, which is generated by rasterizing the same image data of one color, into a plurality of images of the same color and allocating the divided raster data to a plurality of line heads, the line heads to be allocated with the raster data are changed according to the number of pixels printed by each line head. Now, a divided image forming means, that determines the destination print head of the divided raster data according to the number of pixels printed by each line head, will be explained by referring to FIG. 8.

Figure 8:
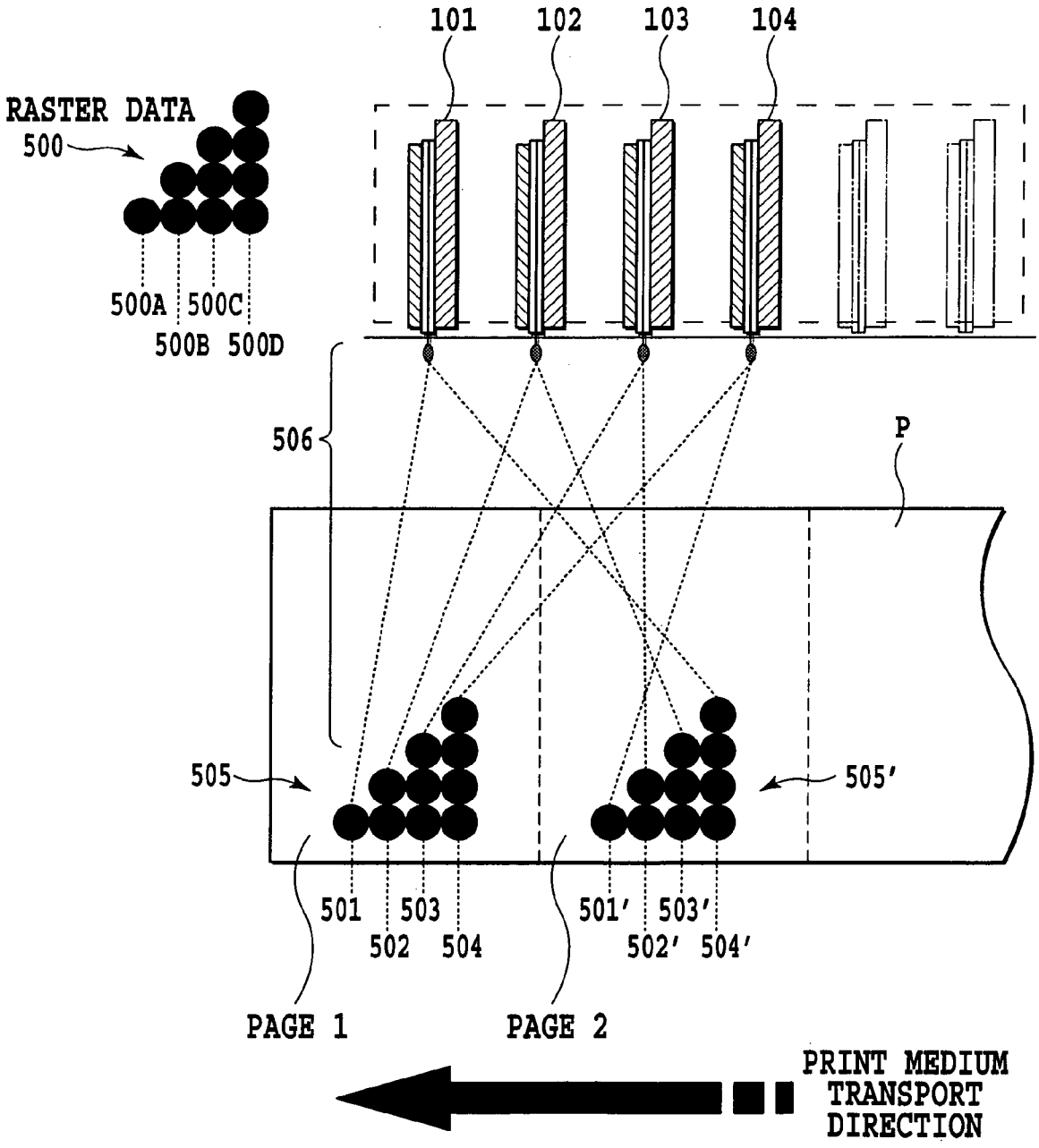
FIG. 8 is an explanatory diagram showing a divided image forming means in the printing apparatus as a second embodiment of this invention.

In FIG. 8, denoted 500 is raster data generated by rasterizing the image data. 500A (1 dot), 500B (2 dots), 500C (3 dots) and 500D (4 dots) are divided raster data.

Processing on the first page allocates the raster data 500A (1 dot) to the line head (101) according to the print medium transport position detection signal from the encoder (not shown) to perform a raster printing (501). Similarly, at the next timing the raster data 500B (2 dots) is allocated to the line head (102), the raster data 500C (3 dots) to the line head (103), and the raster data 500D (4 dots) to the line head (104) for raster printing (501-504) to form an output image 505.

When the processing on the first page is complete, the number of pixels printed by the line head (101) is 1 dot, that of the line head (102) is 2 dots, that of the line head (103) is 3 dots, and that of the line head (104) is 4 dots.

Processing on the second page changes the destination of raster data allocation according to the number of pixels printed by each line head. That is, the raster data with a small number of dots to be printed is allocated to a line head that has printed a large number of dots on the previous page, and the raster data with a large number of dots to be printed is allocated to a line head that has printed a small number of dots on the previous page. For example, according to the print medium transport position detection signal from the encoder (not shown), the raster data 500A (1 dot) is allocated to the line head (104) to perform raster printing (501'). Similarly, at the next timing the raster data 500B (2 dots) is allocated to the line head (103), the raster data 500C (3 dots) to the line head (102), and the raster data 500D (4 dots) to the line head (101) for raster printing (501'-504') to form an output image 505'. Denoted 506 are lines representing a match between the line heads (101-104) and the raster printing (501-504, 501'-504').

When the processing on the second page is complete, the cumulative number of pixels printed by the line head (101) is 5 dots, that of the line head (102) is 5 dots, that of the line head (103) is 5 dots, and that of the line head (104) is 5 dots, indicating all the line heads have been used at the same rate.

While in the above explanation the line heads, the destinations to which the divided raster data is allocated, are successively changed every page according to the number of printed dots, the line head allocation may be changed successively every page according to the cumulative number of printed dots.

In changing the destination line heads according to the number of dots printed by each line head, the line heads to which the raster data is assigned may be determined in a way that makes the frequency of use equal among the line heads, by calculating the total number of dots of the raster data in advance. This is explained by referring to FIG. 9.

Figure 9:
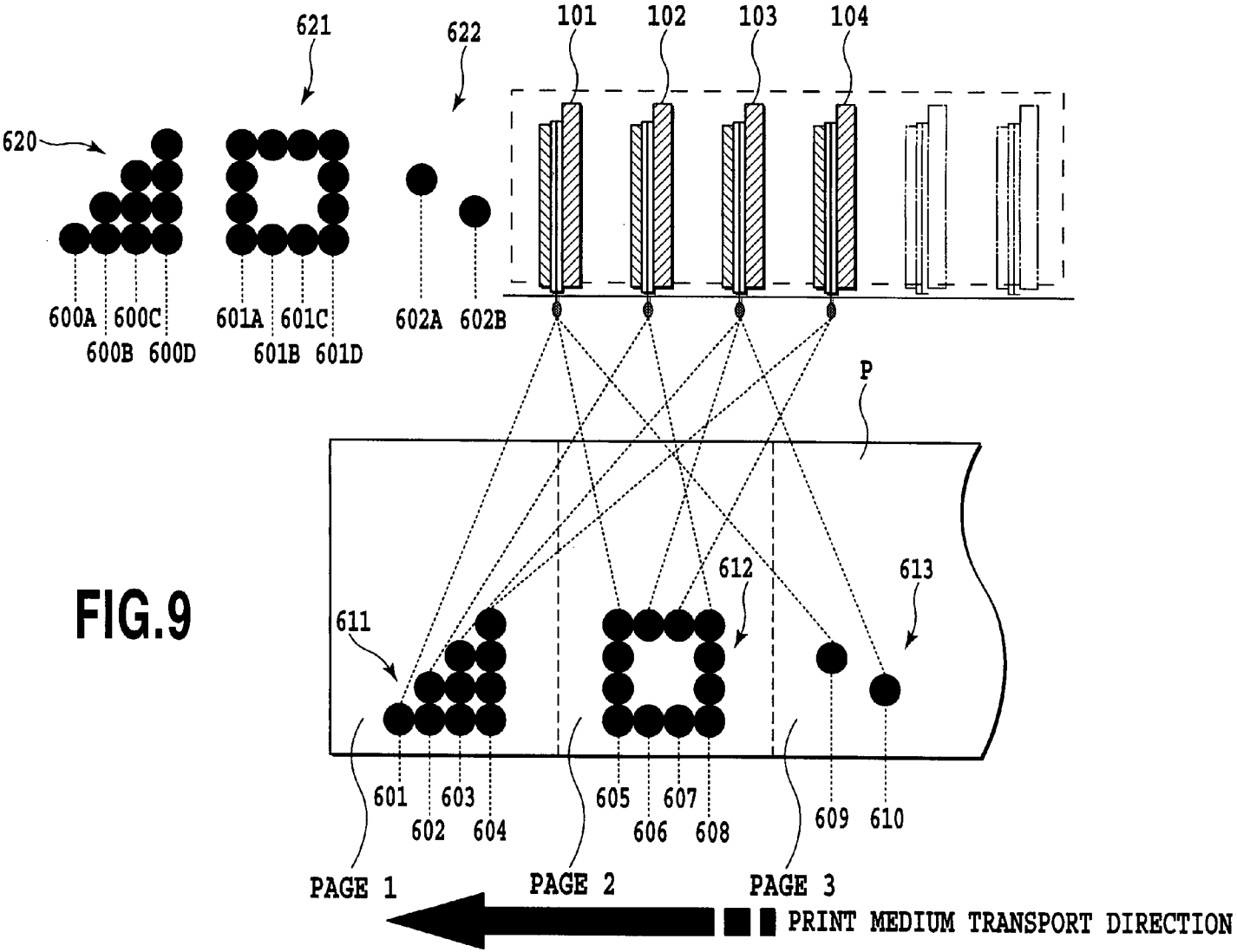
FIG. 9 is an explanatory diagram showing a divided image forming means in the printing apparatus as a third embodiment of this invention.
Figure 10:
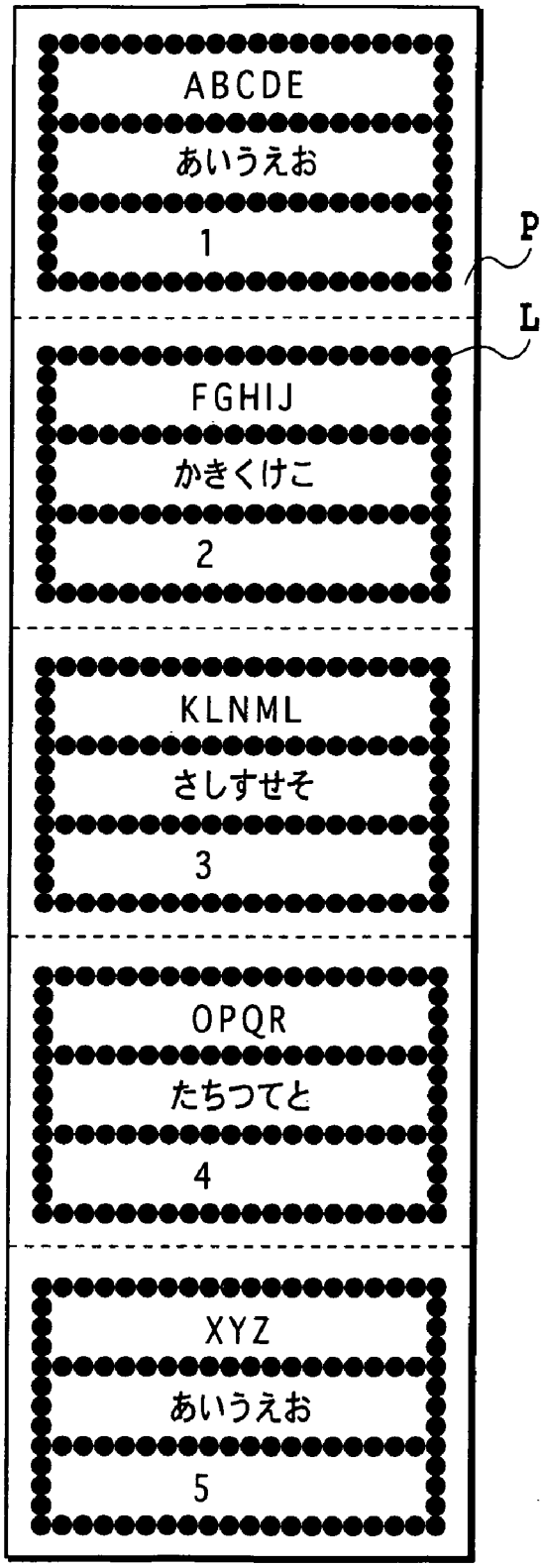
FIG. 10 illustrates one example of image data used in business form printing.

620, 621 and 622 in FIG. 9 represent variable data. 620 represents raster data that is generated by rasterizing the image data of the first page and made up of divided raster data 600A (1 dot), 600B (2 dots), 600C (3 dots) and 600D (4 dots). 621 represents raster data that is generated by rasterizing the image data of the second page and made up of divided raster data 601A (4 dots), 601B (2 dots), 601C (2 dots) and 601D (4 dots). 622 represents raster data that is generated by rasterizing the image data of the third page and made up of divided raster data 602A (1 dot) and 602B (1 dot).

The total number of dots printed in three pages is 24 dots. Dividing the 24 dots so that the cumulative number of printed dots is equal among the four line heads results in six dots of raster data being allocated to each line head.

For example, the raster data 600A (1 dot), 601A (4 dots), 602A (1 dot) is allocated to the line head (101), the raster data 600B (2 dots), 601D (4 dots) to the line head (102), the raster data 600C (3 dots), 601B (2 dots), 602B (1 dot) to the line head (103), and the raster data 600D (4 dots), 601C (2 dots) to the line head (1041) for raster printing (601-610) to form an output image (611-613). When processing on the third page is complete, the cumulative number of pixels printed by each line head is 6 dots.

In another example, the line heads to which the divided raster data is assigned may be determined according to a history of the number of dots printed by the individual line heads. That is, a line head with a large cumulative number of printed dots may be assigned raster data with a small number of dots to be printed, and a line head with a small cumulative number of printed dots may be assigned raster data with a large number of dots to be printed.

While in the second and third embodiments, four black heads have been described to be used as the line heads, it is needless to say that this invention can be applied to any configurations having two or more line heads for the printing of the same color ink. For example, if six black heads are used, an efficiency 1.5 times that of the first embodiment can be obtained (replacement frequency is lowered to ⅔ that of the first embodiment).

Although a monochrome printing apparatus has been taken up as an example in this embodiment, it is possible to use three black heads, one cyan head, one magenta head and one yellow head to configure the apparatus as a full color printing apparatus. In this case, during a monochrome print mode, three black heads may be used to form the above divided image forming means to perform a high-speed printing; and during a full color print mode, a high-quality printing may be done without using the divided image forming means, providing an operator with a variety of choices (print modes).

The printing apparatus used in this invention may be a charge quantity control type, a continuous type using a spray system, or an on-demand type that uses a thermal energy-based bubble jet (tradename) system or a piezoelectric system using a piezoelectric vibration plate. A full line type ink jet print head, which has as many printing elements or nozzles arrayed in a row as will match the printing width, is preferred in terms of throughput because it can print at a very high speed.

Other Embodiments

This invention may be applied to a system made up of a plurality of devices (e.g., host computer, interface devices, reader and printer) or to equipment made up of a single device (e.g., copying machine and facsimile machine).

The object of this invention can also be achieved by loading into a system or equipment a storage medium containing a program code that realizes the functions of the aforementioned embodiments and then by having a computer (or CPU and MPU) in the system or equipment read the program code from the storage medium and execute it.

In this case, the program code, which is read from the storage medium, realizes the functions of the aforementioned embodiments and the storage medium containing the program code also constitutes this invention.

Storage media that may be used for supplying the program code include, for example, floppy disks (tradename), hard disks, optical discs, magnetooptical discs, CD-ROMs, CD-Rs, magnetic tapes, nonvolatile memory cards and ROMs.

This invention includes not only a case where the functions of the aforementioned embodiments are realized by a computer executing the program code read from the storage medium, but also a case where the functions are realized by an operating system (OS) on the computer executing a part or all of the actual processing.

Further, this invention also includes a case in which the functions of the aforementioned embodiments are realized by writing the program code read from the storage medium into a memory on a function expansion board inserted into the computer or on a function extension unit connected to the computer and then by having a CPU incorporated in the function expansion board or function extension unit execute a part or all of the actual processing according to instructions of the program code.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

What is claimed is:

1. An ink jet printing apparatus which forms an image by dividing the image of one color into a plurality of images of the same color and printing the divided images of the same color using a plurality of line heads arranged in a direction in which a print medium is transported by print medium transport means, the ink jet printing apparatus comprising:

ink-ejectable head detection means for detecting such line heads of the plurality of line heads intended to print the images of the same color that can eject ink properly;

image data supply means for dividing image data of one color into a plurality of image data of the same color by the number of the ink ejectable line heads detected by the ink-ejectable head detection means and supplying the divided image data to the ink ejectable line heads; and control means for controlling a printing operation of the ink ejectable line heads according to the divided image data supplied from the image data supply means.

2. An ink jet printing apparatus according to claim 1, wherein the ink-ejectable head detection means comprises:

remaining service life detection means for detecting a remaining service life of each line head; and decision means for setting as an ink ejectable line head each line head whose remaining service life as detected by the remaining service life detection means is longer than a predetermined period.

3. An ink jet printing apparatus according to claim 2, wherein the remaining service life detection means detects the remaining service life of each line head by counting the number of ink ejections from each line head.

4. An ink jet printing apparatus according to claim 1, wherein the ink-ejectable head detection means comprises:

remaining ink volume detection means for detecting a remaining ink volume in each ink tank, the ink tanks supplying ink independently of each other to the associated line heads; and decision means for setting as the ink ejectable line heads each of those line heads whose ink tank's remaining ink volume as detected by the remaining ink volume detection means is greater than a predetermined volume.

5. An ink jet printing apparatus according to claim 4, wherein the remaining ink volume detection means comprises in each ink tank a pair of electrodes with a predetermined gap therebetween and detects whether or not the pair of electrodes is in a conducting state through the ink to determine whether or not the remaining ink volume is greater than the predetermined volume.

6. An ink jet printing apparatus according to any one of claims 1 to 5, wherein the control means controls a transport speed of a print medium transported by the transport means and a frequency of printing performed by each ink ejectable line head, according to the number of ink ejectable line heads detected by the ink-ejectable head detection means.

7. An ink jet printing apparatus according to any one of claims 1 to 5, wherein the image data supply means divides the image data of one color into a plurality of image data of the same color and allocates the divided image data to the ink ejectable line heads such that the number of dots printed by each line head is equal among the line heads.

8. An ink jet printing apparatus according to any one of claims 1 to 5, wherein, when successively dividing raster data, generated by rasterizing image data made up of a plurality of pages of the same color, and allocating the divided raster data to the plurality of line heads, the image data supply means changes the raster data allocation to the line heads at least for every page.

9. An ink jet printing method which forms an image by dividing the image of one color into a plurality of images of the same color and printing the divided images of the same color using a plurality of line heads arranged in a direction in which a print medium is transported by print medium transport means, the ink jet printing method comprising:

an ink-ejectable head detection step to detect those of the plurality of line heads intended to print the images of the same color which can eject ink properly;

an image data dividing step to divide image data of one color into a plurality of image data of the same color by the number of ink ejectable line heads detected by the ink-ejectable head detection step;

an image data supply step to supply the image data divided by the image data dividing step to the ink ejectable line heads; and a control step to control a printing operation of the ink ejectable line heads according to the divided image data supplied from the image data supply step.

10. A storage medium storing a control program, the control program realizing the printing method claimed in claim 9, by using a computer.

11. A control program embodied in a computer readable medium to realize the printing method claimed in claim 9 by using a computer.

12. An information processing device capable of sending image data for a plurality of images of one color to an ink jet printing apparatus that prints the images of one color by using a plurality of line heads arranged in a direction in which print medium transport means transports a print medium, the information processing device comprising:

ink-ejectable head detection means for detecting those of the plurality of line heads intended to print the images of the same color which can eject ink properly;

image data dividing means for dividing image data of one color into a plurality of image data of the same color by the number of ink ejectable line heads detected by the ink-ejectable head detection means; and image data sending means for sending the image data divided by the image data dividing means to the ink jet printing apparatus.

* * * * *